US006868249B2

(12) United States Patent
Kinouchi et al.

(10) Patent No.: US 6,868,249 B2
(45) Date of Patent: Mar. 15, 2005

(54) INDUCTION HEATING FIXING APPARATUS AND IMAGE FORMING APPARATUS

(75) Inventors: Satoshi Kinouchi, Tokyo (JP); Osamu Takagi, Chofu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/387,413

(22) Filed: Mar. 14, 2003

(65) Prior Publication Data

US 2004/0179874 A1 Sep. 16, 2004

(51) Int. Cl.[7] ..... G03G 15/20
(52) U.S. Cl. ..... 399/328; 399/69
(58) Field of Search ..... 399/328, 320, 399/67, 69, 335, 330; 219/216, 619

(56) References Cited

U.S. PATENT DOCUMENTS

| | | | | |
|---|---|---|---|---|
| 5,526,103 A | * | 6/1996 | Kato et al. | 399/328 |
| 5,953,223 A | * | 9/1999 | Kato et al. | 363/69 |
| 6,026,273 A | | 2/2000 | Kinouchi et al. | |
| 6,078,781 A | | 6/2000 | Takagi et al. | |
| 6,087,641 A | | 7/2000 | Kinouchi et al. | |
| 6,337,969 B1 | | 1/2002 | Takagi et al. | |
| 6,438,335 B1 | | 8/2002 | Kinouchi et al. | |
| 6,643,476 B1 | | 11/2003 | Kinouchi et al. | |
| 2002/0051663 A1 | | 5/2002 | Kinouchi et al. | |
| 2003/0053812 A1 | | 3/2003 | Nakayama | |

FOREIGN PATENT DOCUMENTS

| | | | |
|---|---|---|---|
| JP | 03-279964 | * 12/1991 | G03G/15/20 |
| JP | 04-001662 | * 1/1992 | G03G/15/20 |
| JP | 04-051258 | * 2/1992 | G03G/15/20 |
| JP | 04-226480 | * 8/1992 | G03G/15/20 |
| JP | 10-333490 | * 12/1998 | G03G/15/20 |
| JP | 11-191484 A | 7/1999 | |

OTHER PUBLICATIONS

U.S. Appl. No. 10/154,970, filed May 28, 2002, Takagi et al.
U.S. Appl. No. 10/126,618, filed Apr. 22, 2002, Kikuchi et al.
U.S. Appl. No. 10/143,909, filed May 14, 2002, Kinouchi et al.

* cited by examiner

*Primary Examiner*—Quana Grainger
(74) *Attorney, Agent, or Firm*—Foley & Lardner LLP

(57) ABSTRACT

A DC circuit 110 is provided to convert the voltage of a commercial AC power supply 100 into a DC voltage having a fixed level and output the DC voltage irrespective of the level of the voltage. The rectifier circuit 110 includes contacts 117, 118 and 119 and functions as one of a full-wave doubler voltage rectifier circuit and a full-wave rectifier circuit according to the opening and closing of each of the contacts.

14 Claims, 10 Drawing Sheets

INDUCTION HEATING FIXING APPARATUS AND IMAGE FORMING APPARATUS

BACKGROUND OF THE INVENTION

An image forming apparatus reads an image from a document, forms a developer image corresponding to the read image on paper and fixes the developer image on the paper using a fixing apparatus.

The fixing apparatus includes a heating roller and a pressure roller. The fixing apparatus catches the paper-sheet between the heating and pressure rollers and carries it to fix the developer image on the paper-sheet.

An induction heating type fixing apparatus contains a coil inside a heating roller. The coil is supplied with a high-frequency current and generates a high-frequency magnetic field. The high-frequency magnetic field causes an eddy current to be generated on the heating roller. Due to Joule heat based on the eddy current, the heating roller generates heat by itself.

The high-frequency current is generated from a high-frequency generation circuit (which is also called a switching circuit) that is connected to a commercial AC power supply via a rectifier circuit. The high-frequency generation circuit includes a resonance capacitor that forms a resonant circuit together with the coil and a switching element that excites the resonant circuit. The high-frequency current is generated from the output voltage (DC voltage) of the rectifier circuit.

The voltage level of the commercial AC power supply varies from area to area. For example, there are two areas whose voltage levels are 100 V and 200 V, respectively.

No images can properly be fixed if a 200-V fixing device is used in an area where the voltage of the commercial AC power supply is 100 V or if a 100-V fixing device is used in an area where the voltage of the commercial AC power supply is 200 V.

Consequently, two different fixing apparatus of 100 V and 200 V have to be designed and manufactured, which results in the increase in costs.

BRIEF SUMMARY OF THE INVENTION

An object of the present invention is to provide a fixing apparatus capable of always performing a proper fixing operation irrespective of the voltage level of an AC power supply and an image forming apparatus.

A fixing apparatus according to the present invention comprises:

a heating member;

a coil which generates a high-frequency magnetic field to inductively heat the heating member;

a DC circuit which converts a voltage of an AC power supply into a DC voltage having a fixed level, irrespective of a level of the voltage of the AC power supply, and outputs the DC voltage; and a switching circuit connected to an output terminal of the DC circuit and arranged to supply the coil with a high-frequency current to generate the high-frequency magnetic field.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

[1] A first embodiment of the present invention will now be described with reference to the accompanying drawings.

An image forming apparatus according to the present invention includes a scan unit (scan unit 83 described later)

that optically reads an image of a document, a process unit (process unit 95 described later) that forms a developer image corresponding to the image read by the scan unit on image forming paper-sheet, and a fixing device (fixing device 30 described later) that fixes the developer image on the paper-sheet by heating. Since the configuration of the image forming apparatus is described specifically in previously filed U.S. patent application Ser. No. 09/955,089, its descriptions are omitted.

Figure 1:
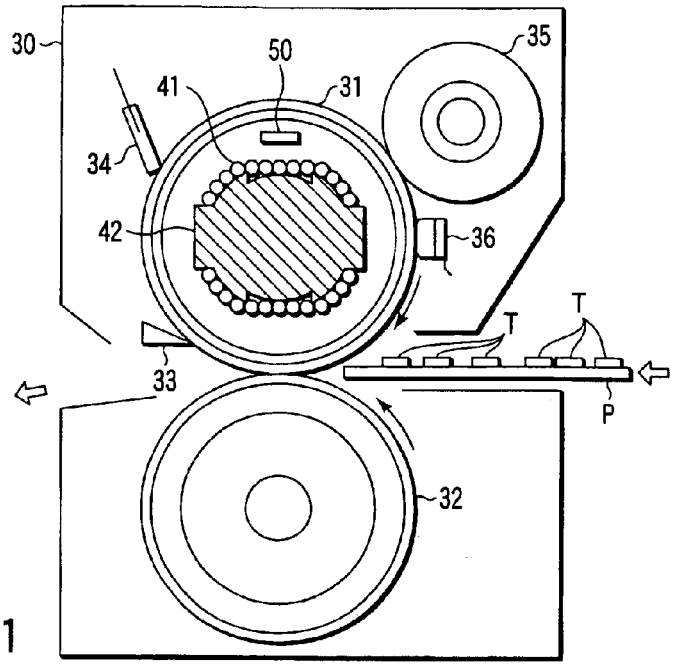
FIG. 1 is a diagram showing a configuration of a fixing apparatus according to first, fifth and sixth embodiments of the present invention.

FIG. 1 shows a configuration of the fixing apparatus 30.

The fixing apparatus 30 includes a heating member, e.g., a heating roller 31. The heating roller 31 and pressure roller 32 are vertically arranged so as to catch a carrying path of image forming paper-sheet P therebetween. The pressure roller 32 is pressed and brought into contact with the outer surface of the heating roller 31 by a pressure mechanism (not shown). The contact portion between the rollers 31 and 32 has a fixed nip width.

The heating roller 31 is obtained by shaping a conductive material such as iron like a cylinder and then coating the outer surface of the cylinder with Teflon. The heating roller 31 rotates in the right direction in FIG. 1. Upon rotation of the heating roller 31, the pressure roller 32 rotates in the left direction in FIG. 1. The paper-sheet P is caught between the heating and pressure rollers 31 and 32 and carried, and heat of the heating roller 31 is transmitted to the paper-sheet P, with the result that the developer image is fixed on the paper-sheet P.

A claw 33 for separating the paper-sheet P from the heating roller 31, a cleaning member 34 for removing the developer, wastepaper and the like from the heating roller 31, an oil coating roller 35 for coating the outer surface of the heating roller 31 with oil, and a temperature sensor 36 for sensing the temperature of the outer surface of the heating 31 roller 31 are arranged around the heating roller 31.

The heating roller 31 contains induction-heating coils 41. The coils 41 are wound around and held by a core 42 and generate a high-frequency magnetic field for induction heating. If the high-frequency magnetic field is applied to the heating roller 31, an eddy current is generated on the heating roller 31 and Joule heat due to the eddy current causes the heating roller 31 to generate heat by itself.

Figure 2:
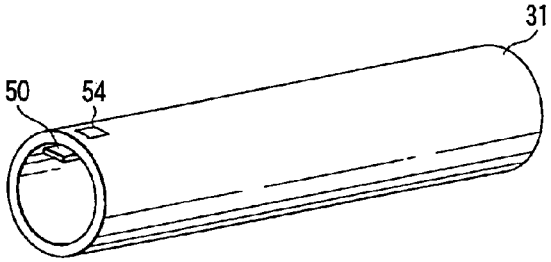
FIG. 2 is an external view of a heating roller in the fixing apparatus according to each of the embodiments of the present invention.
Figure 3:
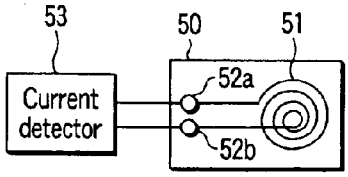
FIG. 3 is a diagram showing a configuration of a magnetic field detector in the fixing apparatus according to each of the embodiments of the present invention.

A magnetic field detector 50 is provided in a space between the coils 41 and the inner surface of the heating roller 31. As shown in FIGS. 2 and 3, the magnetic field detector 50 includes a coil 51 for detecting a high-frequency magnetic field generated from the coils 41 and terminals 52*a* and 52*b* connected to both ends of the coil 51. One end of the magnetic field detector 50 on the terminals 52*a* and 52*b* side is stuck out of the heating roller 31. The coil 51 is made from several turns of copper wires.

When a high-frequency magnetic field is generated from the coils 41, it is detected by the coil 51 to cause a voltage between the terminals 52*a* and 52*b*. In this state, a serviceman's current detector 53 is connected between the terminals 52*a* and 52*b* to cause a current through the current detector 53. The current detector 53 detects the current and displays a detection result by characters and guidelines. This display notifies the serviceman that a high-frequency magnetic field is generated from the coils 41.

A sticker 54 that senses the temperature of the outer surface of the heating roller 31 and discolors is stuck on that end portion of the outer surface of the heating roller 31 which the paper-sheet P does not contact. If the heating roller 31 generates heat by itself and increases in temperature, the sticker 54 discolors. Due to the discoloration of the sticker 54, the serviceman can easily know that the heating roller 31 increases in temperature. The serviceman can thus be prevented from being burnt.

Figure 4:
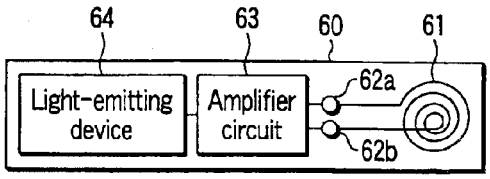
FIG. 4 is a diagram showing a configuration of a modification to the magnetic field detector in the fixing apparatus according to each of the embodiments of the present invention.

The magnetic field detector 50 shown in FIG. 3 can be replaced by a magnetic field detector 60 shown in FIG. 4. The detector 60 includes a coil 61 for detecting a high-frequency magnetic field generated from the coils 41, terminals 62*a* and 62*b* connected to both ends of the coil 61, an amplifier circuit 63 for amplifying a voltage generated between the terminals 62*a* and 62*b*, and a light-emitting device (e.g., light-emitting diode) 64 connected to the output terminal of the amplifier circuit 63.

When a high-frequency magnetic field is generated from the coils 41, it is detected by the coil 61 to cause a current to flow through the light-emitting device 64. Thus, the light-emitting device 64 emits light to make a notification that the high-frequency magnetic filed is generated. If the voltage generated between the terminals 62*a* and 62*b* has a level enough to emit light from the light-emitting device 64, the amplifier circuit 63 can be eliminated.

Figure 5:
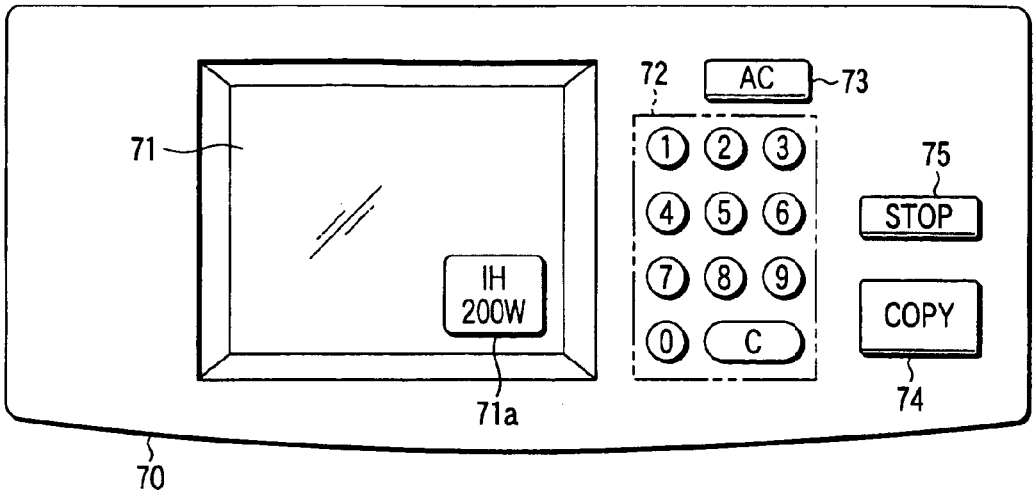
FIG. 5 is a diagram showing a configuration of a control panel in an image forming apparatus according to each of the embodiments of the present invention.

On the other hand, a control panel 70 shown in FIG. 5 is provided on the top of the main body of the image forming apparatus described above. The control panel 70 includes a touch panel liquid crystal display section 71, a plurality of keys 72 for inputting numeric values, an all clear key 73, a copy key 74 and a stop key 75. The liquid crystal display section 71 is capable of inputting information with the touch of a finger and displaying various items of information including the input information. The induction heating output (e.g., IH200 W) of the coils 41 is displayed on a display area 71*a* in the liquid crystal display section 71.

Figure 6:
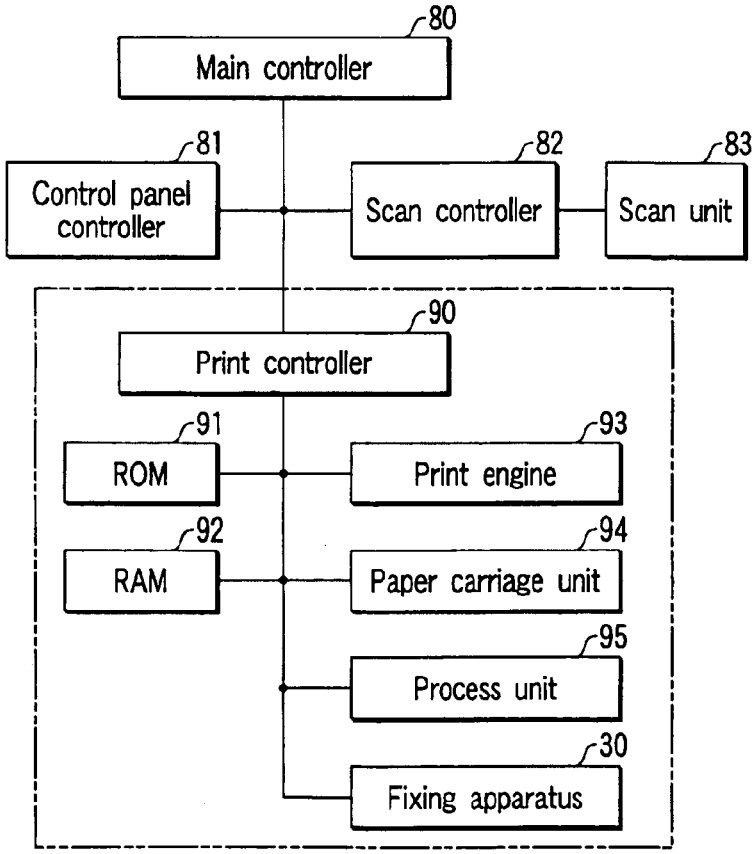
FIG. 6 is a block diagram of a control circuit in the image forming apparatus according to each of the embodiments of the present invention.

FIG. 6 shows a control circuit of the image forming apparatus described above.

A control panel controller 81, a scan controller 82 and a print controller 90 are connected to a main controller 80.

The main controller 80 controls the controllers 81, 82 and 90 together. The control panel controller 81 controls the control panel 70. The scan controller 82 controls a scan unit 83 that optically reads an image of a document.

A ROM 91 for storing control programs, a RAM 92 for storing data, a print engine 93, a paper carriage unit 94, a process unit 95 and a fixing apparatus 30 are connected to the print controller 90. The print engine 93 emits a laser beam to form an image read by the scan unit 83 on a photosensitive drum of the process unit 95. The paper carriage unit 94 includes a carriage mechanism for paper-sheet P and its driving circuit. The process unit 95 forms an electrostatic latent image corresponding to the image read by the scan unit 83 on the surface of the photosensitive drum by the laser beam emitted from the print engine 93, develops the electrostatic latent image using a developer, and transfers a developer image onto the paper-sheet P.

Figure 7:
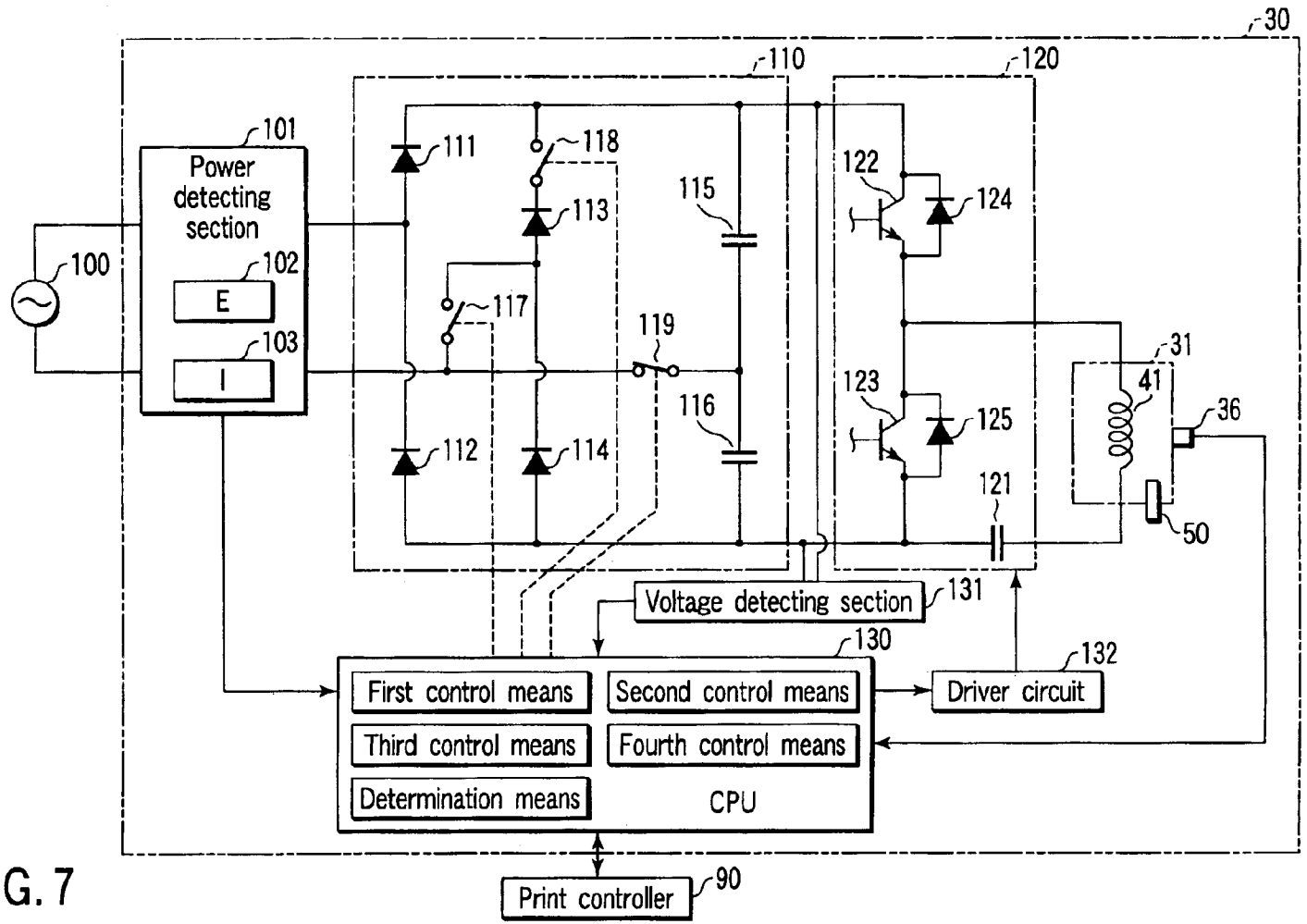
FIG. 7 is a block diagram of an electric circuit of a fixing apparatus according to each of first to fourth embodiments of the present invention.

FIG. 7 shows an electric circuit of the fixing apparatus 30.

A rectifier circuit 110 is connected to a commercial AC power supply 100 through a power detecting section 101 and a high-frequency generation circuit (a switching circuit or a half bridge inverter) 120 is connected to the output terminal of the rectifier circuit 110.

The rectifier circuit 110 includes diodes 111, 112, 113 and 114, capacitors 115 and 116 and contacts 117, 118 and 119. The circuit 110 serves as one of a full-wave voltage doubler rectifier circuit (first rectifier circuit) and a full-wave rectifier circuit (second rectifier circuit) in accordance with the opening and closing of the contacts 117, 118 and 119. The contacts 117, 118 and 119 are automatically opened and closed under the control of a CPU 130.

Figure 8:
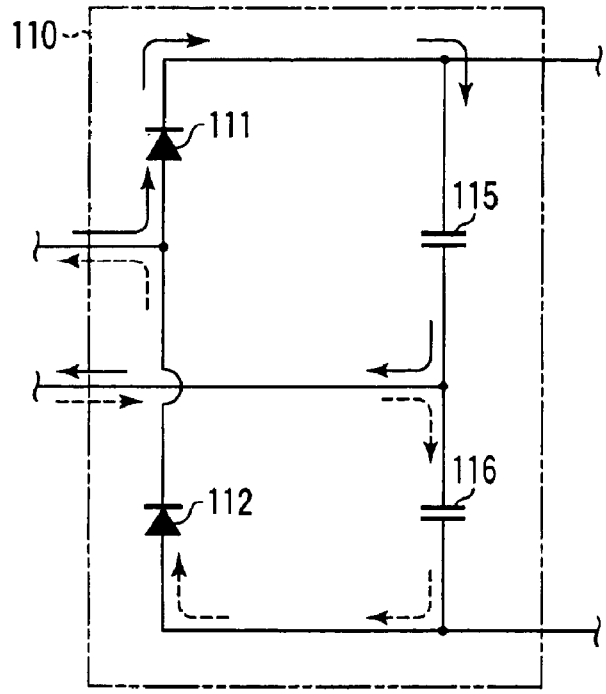
FIG. 8 is a diagram showing a current path that is formed when a rectifier circuit shown in FIG. 7 functions as a full-wave voltage doubler rectifier circuit.

If the contacts 117 and 118 are opened and the contact 119 is closed as shown in the figure, a full-wave voltage doubler rectifier circuit having a current path is formed as shown in FIG. 8. The full-wave voltage doubler rectifier circuit causes a current to flow in the direction of arrows in solid lines in FIG. 8 when the voltage level of the commercial AC power supply 100 is positive and causes a current to flow in the direction of arrows in broken lines in FIG. 8 when the voltage level of the commercial AC power supply 100 is negative. The voltage (e.g., 100 V) of the commercial AC power supply 100 is thus converted into a DC voltage whose level is doubled (200 V).

Figure 9:
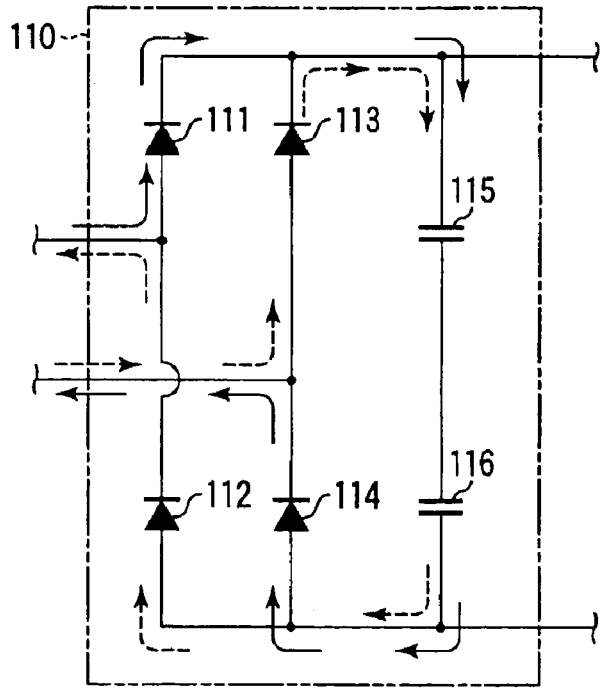
FIG. 9 is a diagram of the state of the rectifier circuit shown in FIG. 7 which functions as a full-wave rectifier circuit.
Figure 10:
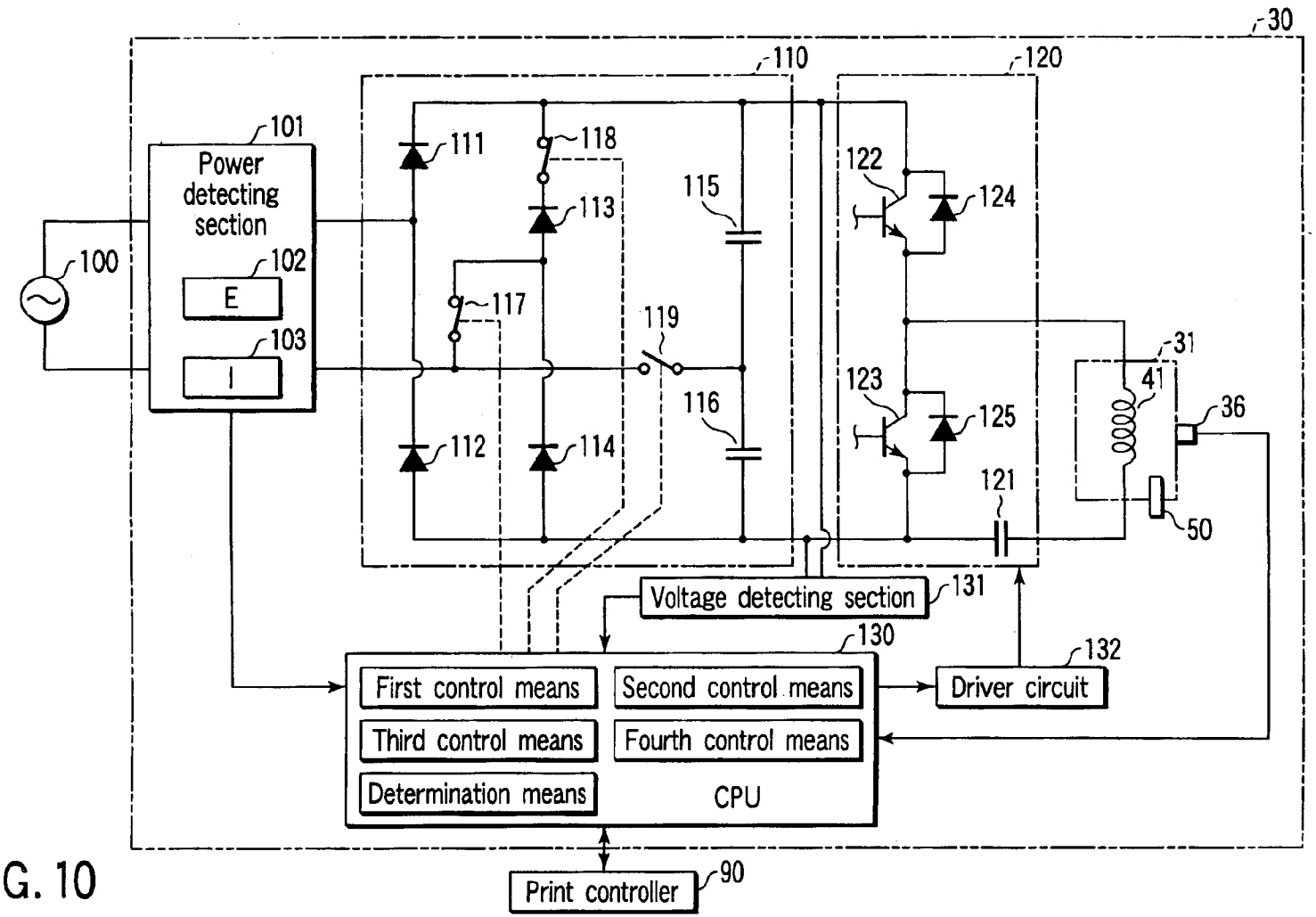
FIG. 10 is a block diagram showing a current path of the rectifier circuit shown in FIG. 9.

If the contacts 117 and 118 are closed and the contact 119 is opened as shown in FIG. 9, a full-wave rectifier circuit having a current path as shown in FIG. 10 is formed. The full-wave rectifier circuit causes a current to flow in the direction of arrows in solid lines in FIG. 9 when the voltage level of the commercial AC power supply 100 is positive and causes a current to flow in the direction of arrows in broken lines in FIG. 9 when the voltage level of the commercial AC power supply 100 is negative. The voltage (e.g., 200 V) of the commercial AC power supply 100 is converted into a DC voltage whose level is the same (200 V).

The above high-frequency generation circuit 120 includes a resonant capacitor 121 which forms a resonant circuit together with the coils 41, switching devices for exciting the resonant circuit, e.g., transistors 122 and 123, and damper diodes 124 and 125 connected in parallel to the transistors 122 and 123, respectively. The transistors 122 and 123 are turned on and off by a driver circuit 132 and accordingly the high-frequency generation circuit 120 generates a high-frequency current.

If the high-frequency current generated by the high-frequency generation circuit 120 is supplied to the coils 41, the coils 41 generate a high-frequency magnetic field. The high-frequency magnetic field causes an eddy current on the heating roller 31 and Joule heat based on the eddy current causes the heating roller 31 to generate heat by itself.

The power detecting section 101 includes a voltage detecting section 102 which detects a level E of the voltage of the commercial AC power supply 100 and a current detecting section 103 which detects a level I of the current input to the DC circuit 110. Based on the detection results of the detecting sections 102 and 103, the power detecting section 101 detects a voltage input to the fixing apparatus 30. The detection result of the power detecting section 101 is supplied to the CPU 130.

A voltage detecting section 131 is connected to the output terminal of the rectifier circuit 110 to detect a level of the output voltage of the rectifier circuit 110. The detection result of the voltage detecting section 131 is supplied to the CPU 130.

The above-described temperature sensor 36, print controller 90 and driver circuit 132 are connected to the CPU 130.

The CPU 130 has the following means (1) to (5) as the principal functions:

(1) First control means for controlling the opening and closing of the contacts 117, 118 and 119 in accordance with the detection results of the voltage detecting section 102.

(2) Determination means for determining a malfunction of the rectifier circuit 110 in accordance with the detection result of the voltage detecting section 131.

(3) Second control means for, when the determination means determines a malfunction, making a notification of the malfunction by characters displayed on the liquid crystal display section 71 of the control panel 70 and inhibiting the operation of the high-frequency generation circuit 120 (driving of the driver circuit 132).

(4) Third control means for controlling the output of the high-frequency generation circuit 120 (driving of the driver circuit 132) such that the temperature sensed by the temperature sensor 36 is maintained at a predetermined set one.

(5) Fourth control means for displaying the input power detected by the power detecting section 101 on the liquid crystal display section 71 of the control panel 70 as an induction heating output of the coil 41.

Figure 11:
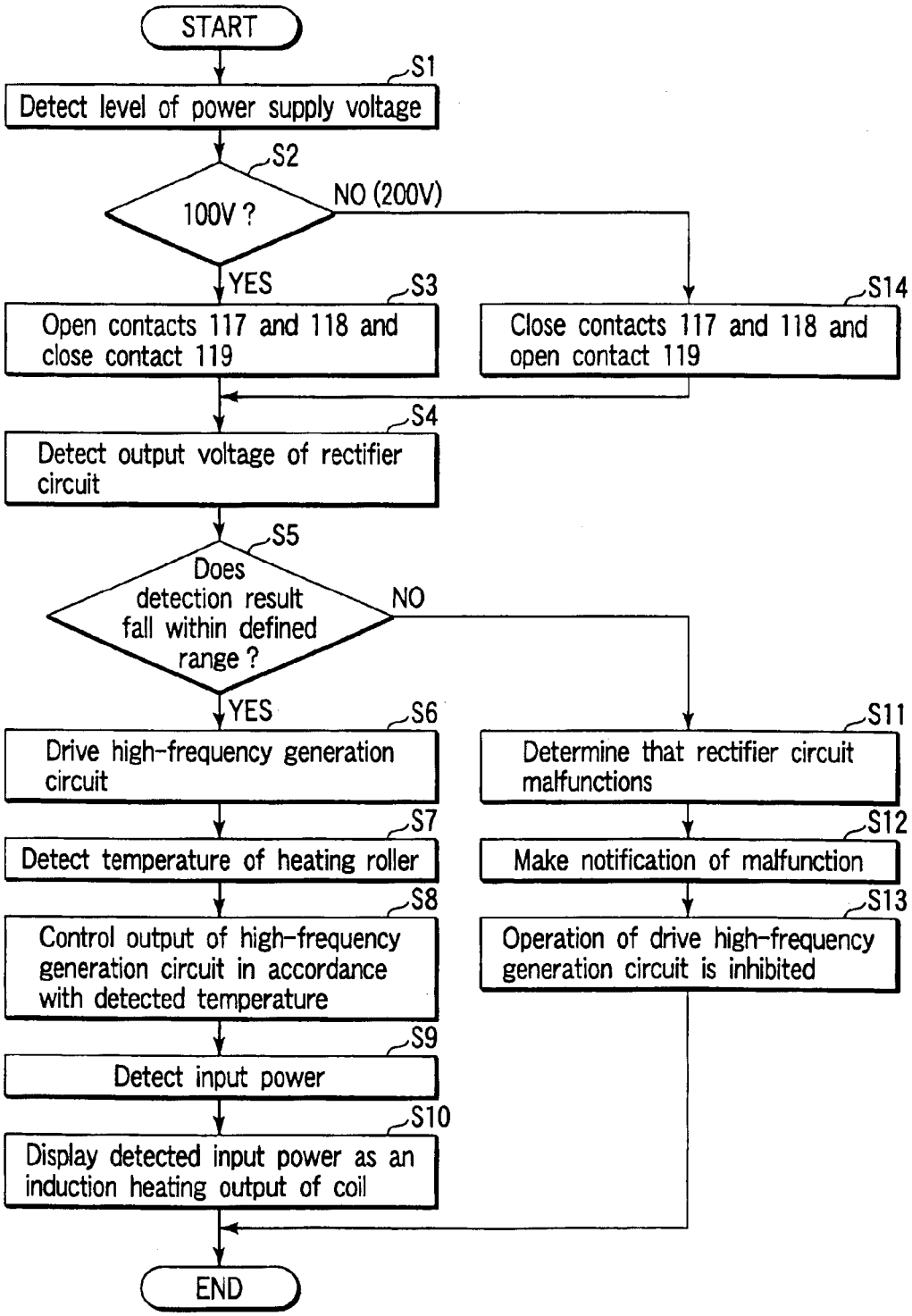
FIG. 11 is a flowchart illustrating an operation of a fixing apparatus according to the first to fifth embodiments of the present invention.

An operation of the fixing apparatus 30 so configured will now be described with reference to the flowchart shown in FIG. 11.

First, the operation of the fixing apparatus 30 performed when the voltage of the commercial AC power supply 100 is 100 V will be described.

When the commercial AC power supply 100 turns on, its voltage level E is detected by the voltage detecting section 102 (step S1). If the detection result of the detector 102 is 100 V (YES in step S2), the contacts 117 and 118 in the rectifier circuit 110 are opened and the contact 119 therein is closed (step S3).

When the contacts 117 and 118 are opened and the contact 119 is closed, the rectifier circuit 110 functions as a full-wave voltage doubler rectifier circuit. In other words, the voltage of the commercial AC power supply 100 is converted into a DC voltage of 200 V by the rectifier circuit 110. The output voltage of the rectifier circuit 110 is detected by the voltage detecting section 131 (step S4).

If the detection result of the voltage detecting section 131 falls within a defined range having a median value of 200 V (YES in step S5), the high-frequency generation circuit 120 is driven (step S6). This driving causes the circuit 120 to generate a high-frequency current, and the high-frequency current is supplied to the coils 41. Thus, the coils 41 generate a high-frequency magnetic field and the heating roller 31 is inductively heated by the high-frequency magnetic field.

The temperature of the heating roller 31 is sensed by the temperature sensor 36 (step S7). The output of the high-frequency generation circuit 120 is so controlled that the sensed temperature is maintained at a predetermined set one (step S8).

The power input to the fixing apparatus 30 is detected by the power detecting section 101 (step S9). This detection result is displayed in a display area 71*a* of the liquid crystal display section 71 in the control panel 70 as an induction heating output of the coils 41 (step S10).

When neither of the contacts 117 and 118 is opened or the contact 119 is not closed, the rectifier circuit 110 remains as a full-wave rectifier circuit and thus outputs a DC voltage of 100 V. In this case, the detection result of the voltage detecting section 131 does not fall within a defined range having a median value of 200 V (NO in step S5), it is determined that the rectifier circuit 110 malfunctions (step S11).

When it is determined that the rectifier circuit 110 malfunctions, the malfunction is displayed by characters on the liquid crystal display section 71 of the control panel 70 (step S12) and the operation of the high-frequency generation circuit 120 (driving of the driver circuit 132) is inhibited (step S13).

On the other hand, when the voltage of the commercial AC power supply 100 is 200 V, the voltage detected by the voltage detecting section 102 becomes 200 V (NO in step S2). In this case, the contacts 117 and 118 in the rectifier circuit 110 are closed and the contact 119 is opened (step S14).

If the contacts 117 and 118 are closed and the contact 119 is opened, the rectifier circuit 110 functions as a full-wave rectifier circuit. In other words, the voltage of the commercial AC power supply 100 is converted into a DC voltage of 200 V by the rectifier circuit 110. The output voltage of the rectifier circuit 110 is detected by the voltage detecting section 131 (step S4).

If the detection result of the voltage detecting section 131 falls within a defined range having a median value of 200 V (YES in step S5), the operations of the above steps S6 to S10 are performed.

When neither of the contacts 117 and 118 is closed or the contact 119 is not opened, the rectifier circuit 110 remains as a full-wave voltage doubler rectifier circuit and thus the rectifier circuit 110 outputs a DC voltage that is as high as 400 V. In this case, the detection result of the voltage detecting section 131 does not fall within the defined range (NO in step S5), it is determined that the rectifier circuit 110 malfunctions (step S11).

When it is determined that the rectifier circuit 110 malfunctions, the malfunction is displayed by characters on the liquid crystal display section 71 in the control panel 70 (step S12) and the operation of the high-frequency generation circuit 120 (the driving of the driver circuit 132) is inhibited (step S13).

As described above, whether the voltage of the commercial AC power supply 100 is 100 V or 200 V, a DC voltage of 200 V is always applied to the high-frequency generation circuit 120. Proper fixing can thus always be performed irrespective of the voltage level of the commercial AC power supply 100.

The high-frequency generation circuit 120 and coils 41 each can be limited to the specification of 200 V irrespective of the voltage of the commercial AC power supply 100. This limitation allows a reduction in cost.

In the foregoing first embodiment, the contacts 117, 118 and 119 of the rectifier circuit 110 are automatically opened and closed under the control of the CPU 130, but they can be done by hand. Moreover, the contacts 117, 118 and 119 can be replaced with jumper wires and the jumper wires can selectively be cut in accordance with the voltage level of the commercial AC power supply 100.

[2] A second embodiment of the present invention will now be described.

Figure 12:
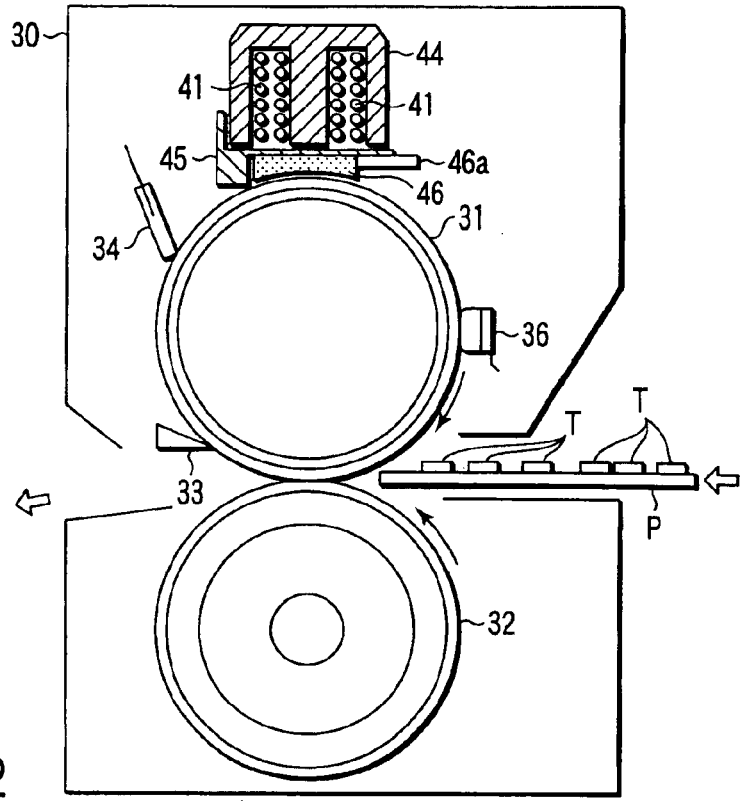
FIG. 12 is a diagram showing a configuration of the fixing apparatus according to a second embodiment of the present invention.

As shown in FIG. 12, coils 41 are provided outside a heating roller 31. The coils 41 are mounted on a core 44 and the core 44 is held by a holding member 45. The holding member 45 always maintains a fixed distance between each of the coils 41 and the heating roller 31.

The holding member 45 is provided with an oil coating member 46, and the oil coating member 46 slides on the outer surface of the heating roller 31. The oil coating member 46 is made of felt and contains oil. The oil is applied to the outer surface of the heating roller 31. The oil coating member 46 has a grip 46*a*. If an operator holds and pulls the grip 46*a*, he or she can remove the coating member 46 from the holding member 45 and replace it with another one.

The oil coating member 46 is adopted in place of the oil coating roller 35 of the first embodiment.

Since the coils 41 are provided outside the heating roller 31 as described above, the heating roller 31 can be decreased in size.

The other configurations, operations and advantages are the same as those of the first embodiment.

[3] A third embodiment of the present invention will now be described.

Figure 13:
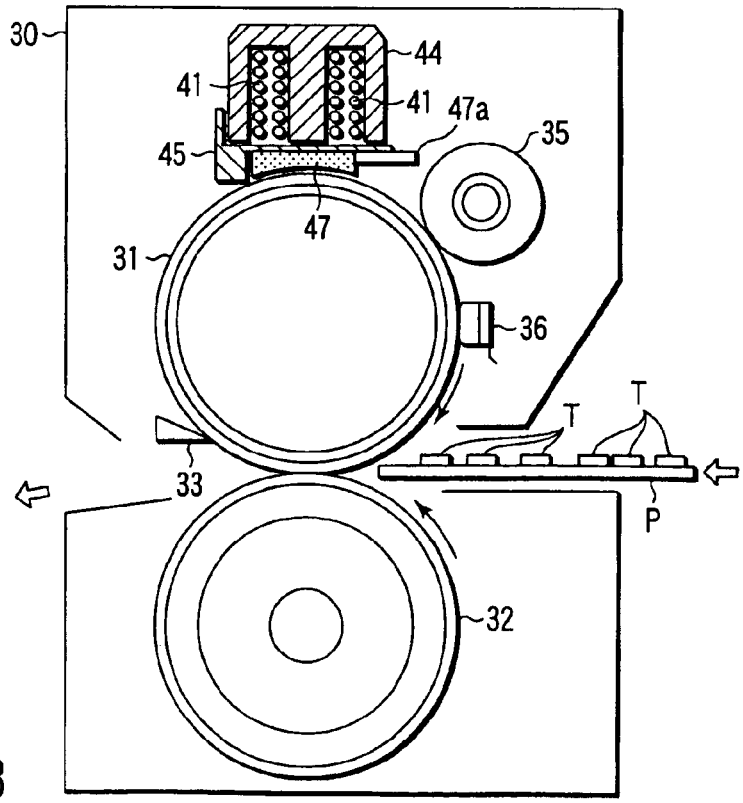
FIG. 13 is a diagram showing a configuration of the fixing apparatus according to a third embodiment of the present invention.

As shown in FIG. 13, coils 41 are provided outside a heating roller 31. The coils 41 are mounted on a core 44 and the core 44 is held by a holding member 45.

The holding member 45 is provided with a cleaning member 47 and the cleaning member 47 slides on the outer surface of the heating roller 31. The cleaning member 47 is made of felt and used to remove a developer and dust from the outer surface of the heating roller 31. The cleaning member 47 has a grip 47*a*. If an operator holds and pulls the grip 47*a*, he or she can remove the cleaning member 47 from the holding member 45 and replace it with another one.

The cleaning member 47 is adopted in place of the cleaning member 34 of the first and second embodiments.

Since the coils 41 are provided outside the heating roller 31 as described above, the heating roller 31 can be decreased in size.

The other configurations, operations and advantages are the same as those of the first embodiment.

[4] A fourth embodiment of the present invention will now be described.

Figure 14:
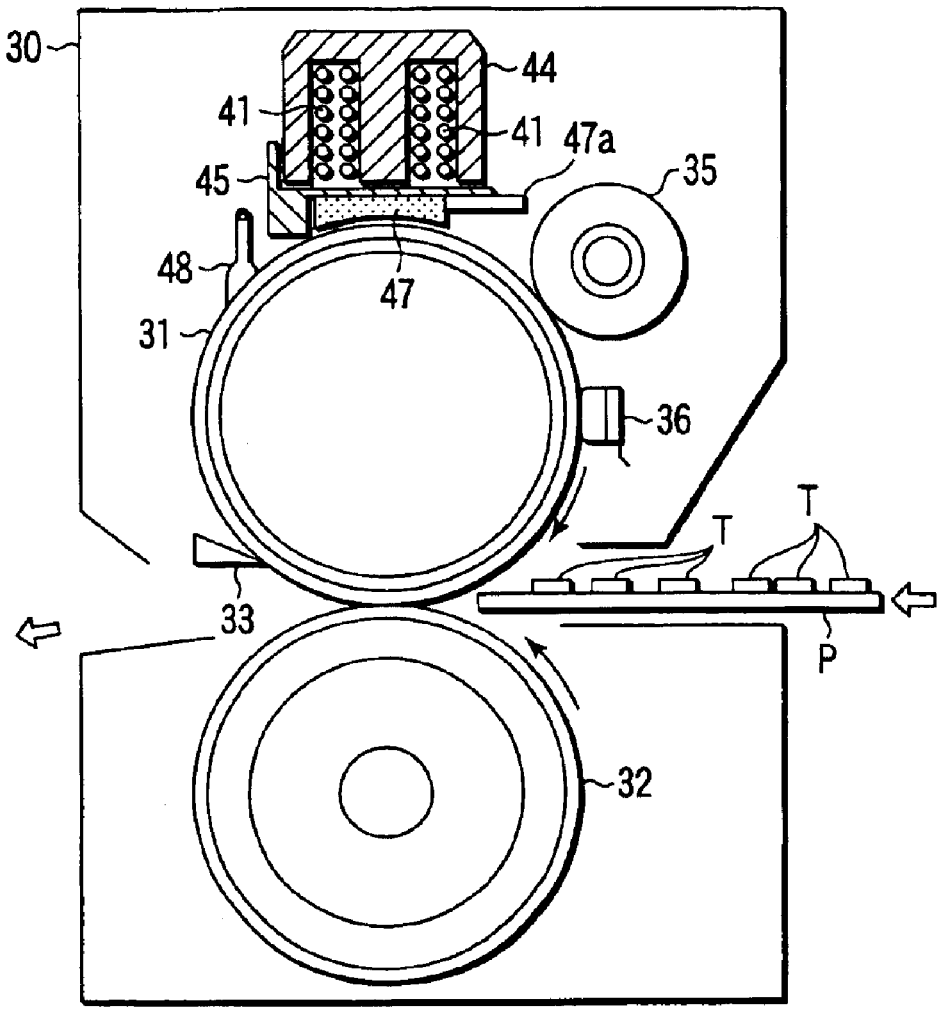
FIG. 14 is a diagram showing a configuration of the fixing apparatus according to a fourth embodiment of the present invention.

As shown in FIG. 14, an eliminating member 48 contacts that area of the outer surface of a heating roller 31 which is located upstream of a location corresponding to a core 44. The eliminating member 48 is used to eliminate an object adhering to the outer surface of the heating roller 31.

For example, even though paper P passes a lug 33 and moves toward the core 44 without being separated from the outer surface of the heating roller 31 by the lug 33, it can reliably be eliminated by the eliminating member 48. It is thus possible to prevent the paper P from being caught between the cleaning member 47 and heating roller 31.

The other configurations, operations and advantages are the same as those of the third embodiment.

[5] A fifth embodiment of the present invention will now be described.

Figure 15:
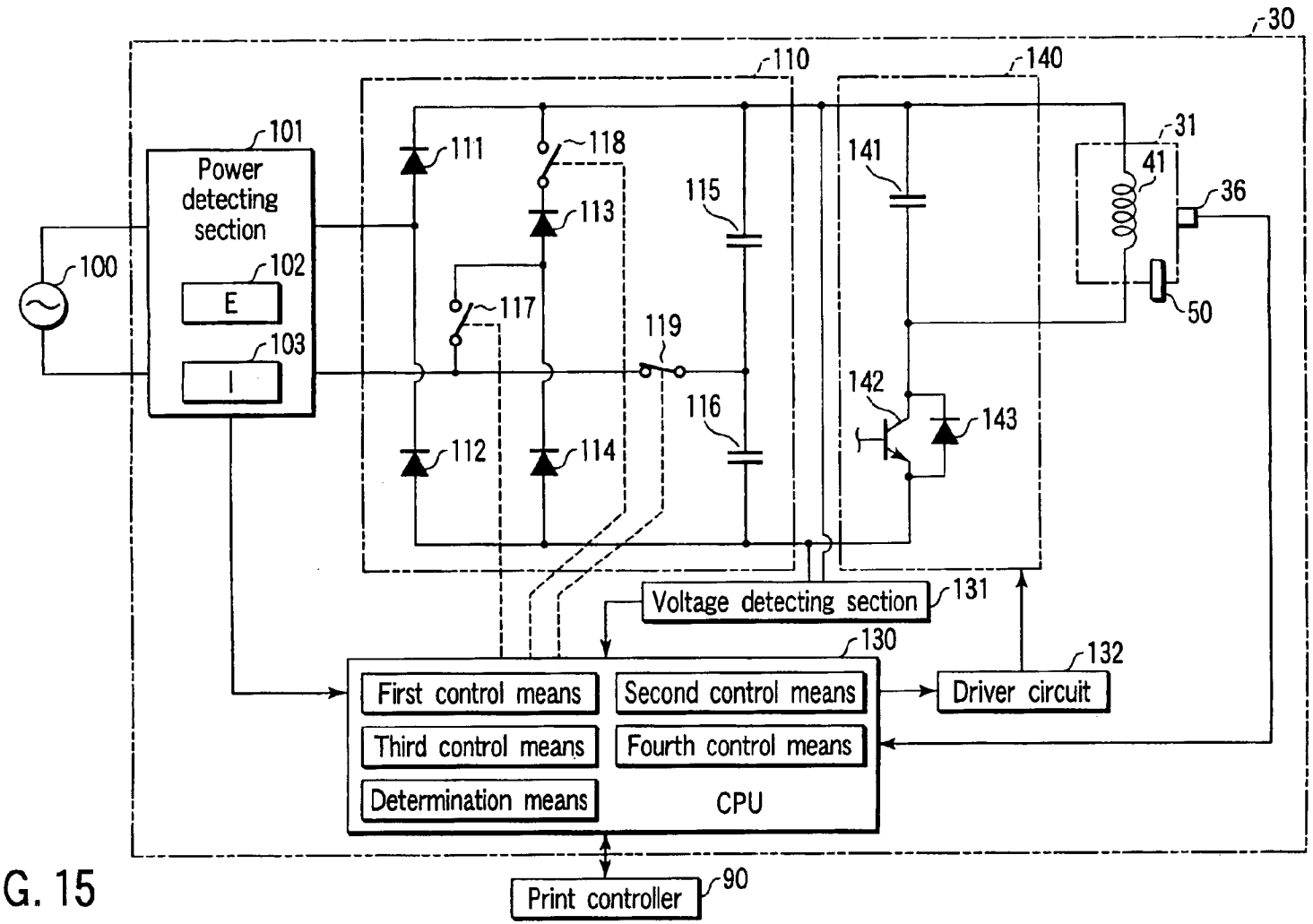
FIG. 15 is a block diagram showing an electric circuit of the fixing apparatus according to a fifth embodiment of the present invention.

As shown in FIG. 15, a high-frequency generation circuit (which is also called a quasi-class-E inverter) 140 is adopted in place of the high-frequency generating circuit 120.

The high-frequency generation circuit 140 includes a resonant capacitor 141 which forms a resonant circuit together with a coil 41, a switching device for exciting the resonant circuit, e.g., a transistor 142, and a damper diode 143 connected in parallel to the transistor 142. The transistor 142 is turned on and off by a driver circuit 132 to generate a high-frequency current from the output voltage of the rectifier circuit 110.

The other configurations, operations and advantages are the same as those of the third embodiment.

[6] A sixth embodiment of the present invention will now be described.

Figure 16:
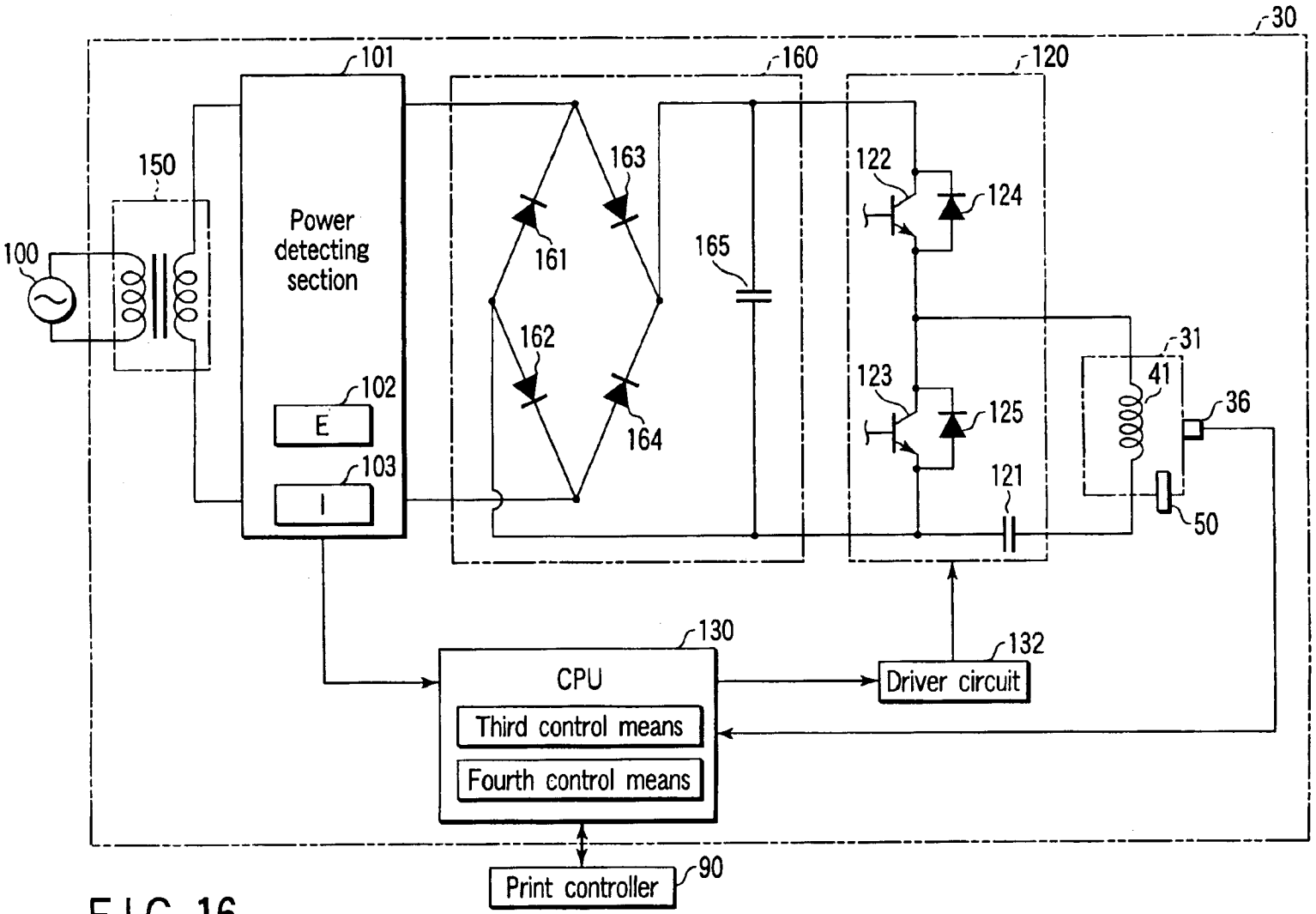
FIG. 16 is a block diagram showing an electric circuit of the fixing apparatus according to a sixth embodiment of the present invention.

As shown in FIG. 16, a transformer 150 is connected between a commercial AC power supply 100 and a power detecting section 101. The transformer 150 is used to convert an AC voltage of 100 V into that of 200 V and adopted when the voltage of the commercial AC power supply 100 is 100 V.

When the voltage of the commercial AC power supply 100 is 200 V, the transformer 150 is eliminated.

Adopting the transformer 150, a full-wave rectifier circuit 160 is used in place of the rectifier circuit 110. The full-wave rectifier circuit 160 includes diodes 161, 1162, 163 and 164 and a capacitor 165 and converts an input AC voltage into a DC voltage of the same level.

Adopting the full-wave rectifier circuit 160, the above-described first control means, second control means and determination means are eliminated from the CPU 130.

If the transformer 150 is selectively used as described above, a DC voltage of 200 V is always applied to the high-frequency generation circuit 120 whether the voltage of the commercial AC power supply 100 is 100 V or 200 V. Proper fixing can thus always be performed irrespective of the voltage level of the commercial AC power supply 100.

The high-frequency generation circuit 120 and coil 41 each can be limited to the specification of 200 V irrespective of the voltage of the commercial AC power supply 100. This limitation allows a reduction in cost.

The other configurations, operations and advantages are the same as those of the third embodiment.

[7] A seventh embodiment of the present invention will now be described.

As shown in FIG. 17, a transformer 170 is connected between a high-frequency generation circuit 120 and a coil 41. The transformer 170 is used to step up the output voltage of the high-frequency generation circuit 120 and adopted when the voltage of the commercial AC power supply 100 is 100 V.

When the voltage of the commercial AC power supply 100 is 200 V, the transformer 150 is eliminated.

Adopting the transformer 170, a full-wave rectifier circuit 160 is adopted in place of the rectifier circuit 110. Adopting the full-wave rectifier circuit 160, the above-described first control means, second control means and determination means are eliminated from the CPU 130.

If the transformer 170 is selectively used as described above, a DC voltage of 200 V is always applied to the high-frequency generation circuit 120 whether the voltage of the commercial AC power supply 100 is 100 V or 200 V. Proper fixing can thus always be performed irrespective of the voltage level of the commercial AC power supply 100.

The other configurations are the same as those of the first embodiment.

Additional advantages and modifications will readily occur to those skilled in the art. Therefore, the invention in its broader aspects is not limited to the specific details and representative embodiments shown and described herein. Accordingly various modifications may be made without departing from the spirit or scope of the general inventive concept as defined by the appended claims and their equivalents.

What is claimed is:

1. A fixing apparatus comprising:

a heating member;

a coil which generates a high-frequency magnetic field by a high-frequency currently flowing therethrough to inductively heat the heating member;

a rectifier circuit which converts a voltage of an AC power supply into a DC voltage having a predetermined level, irrespective of a level of the voltage of the AC power supply; and a high-frequency generation circuit which generates the high-frequency current from an output voltage of the rectifier circuit, wherein the rectifier circuit includes a plurality of diodes, a plurality of capacitors and a plurality of contacts and functions as one of a first rectifier circuit and a second rectifier circuit in accordance with opening and closing of each of the contacts, the first rectifier circuit converting the voltage of the AC power supply into a DC voltage whose level is twice as high as that of the voltage of the AC power supply and the second rectifier circuit converting the voltage of the AC power supply into a DC voltage whose level is equal to that of the voltage of the AC power supply.

2. The apparatus according to claim 1, further comprising:

a voltage detecting section which detects a level of the voltage of the AC power supply; and a control section which controls opening and closing of each of the contacts in accordance with a detection result of the voltage detecting section.

3. The apparatus according to claim 1, further comprising:

a first voltage detecting section which detects a level of the voltage of the AC power supply;

a first control section which controls opening and closing of each of the contacts in accordance with a detection result of the voltage detecting section;

a second voltage detecting section which detects a level of the output voltage of the rectifier circuit;

a determination section which determines a malfunction of the rectifier circuit in accordance with a detection result of the second voltage detecting section; and a second control section which makes a notification of the malfunction of the rectifier circuit and inhibits the high-frequency generation circuit from operating when the determination section determines the malfunction of the rectifier circuit.

4. The apparatus according to claim 1, further comprising a sticker which is attached to an outer surface of the heating member and discolors due to temperature of the outer surface of the heating member.

5. The apparatus according to claim 1, wherein the coil is provided outside the heating member.

6. The apparatus according to claim 5, further comprising:

a core on which the coil is mounted;

a holding member which holds the core; and an oil coating member which is provided in the holding member and coats an outer surface of the heating member with oil.

7. The apparatus according to claim 5, further comprising:

a core on which the coil is mounted;

a holding member which holds the core; and a cleaning member which is provided in the holding member and cleans an outer surface of the heating member.

8. The apparatus according to claim 5, further comprising:

a core on which the coil is mounted;

a holding member which holds the core; and an eliminating member which contacts an area of an outer surface of the heating member, which is located upstream of a position corresponding to the core, and eliminates an object adhering to the outer surface of the heating member.

9. A fixing apparatus comprising:

a heating member;

a coil which generates a high-frequency magnetic field by a high-frequency currently flowing therethrough to inductively heat the heating member;

a rectifier circuit which converts a voltage of an AC power supply into a DC voltage having a predetermined level, irrespective of a level of the voltage of the AC power supply;

a high-frequency generation circuit which generates the high-frequency current from an output voltage of the rectifier circuit;

a power detecting section which detects a voltage of the AC power supply and a current input to the DC circuit and detects power input to the apparatus based on detection results of the voltage and current; and a display section which displays a detection result of the power detecting section as an induction heating output of the coil.

10. A fixing apparatus comprising:

a heating member;

a coil which generates a high-frequency magnetic field by a high-frequency currently flowing therethrough to inductively heat the heating member;

a rectifier circuit which converts a voltage of an AC power supply into a DC voltage having a predetermined level, irrespective of a level of the voltage of the AC power supply;

a high-frequency generation circuit which generates the high-frequency current from an output voltage of the rectifier circuit; and a magnetic field detector which detects the high-frequency magnetic field generated from the coil.

11. An image forming apparatus comprising:

a reading section which reads an image of a document;

a process unit which forms the image read by the reading section on image forming paper; and a fixing apparatus which fixes the image, which is formed on the paper, on the paper by heating, the fixing apparatus comprising:

a heating member;

a coil which generates a high-frequency magnetic field by a high-frequency current flowing therethrough to inductively heat the heating member;

a rectifier circuit which converts a voltage of an AC power supply into a DC voltage having a predetermined level, irrespective of a level of the voltage of the AC power supply; and a high-frequency generation circuit which generates the high-frequency current from an output voltage of the rectifier circuit, wherein the rectifier circuit includes a plurality of diodes, a plurality of capacitors and a plurality of contacts and functions as one of a first rectifier circuit and a second rectifier circuit in accordance with opening and closing of each of the contacts, the first rectifier circuit converting the voltage of the AC power supply into a DC voltage whose level is twice as high as that of the voltage of the AC power supply and the second rectifier circuit converting the voltage of the AC power supply into a DC voltage whose level is equal to that of the voltage of the AC power supply.

12. The apparatus according to claim 11, further comprising:

a voltage detecting section which detects a level of the voltage of the AC power supply; and a control section which controls opening and closing of each of the contacts in accordance with a detection result of the voltage detecting section.

13. The apparatus according to claim 11, further comprising:

a first voltage detecting section which detects a level of the voltage of the AC power supply;

a first control section which controls opening and closing of each of the contacts in accordance with a detection result of the voltage detecting section;

a second voltage detecting section which detects a level of the output voltage of the rectifier circuit;

a determination section which determines a malfunction of the rectifier circuit in accordance with a detection result of the second voltage detecting section; and a second control section which makes a notification of the malfunction of the rectifier circuit and inhibits the high-frequency generation circuit from operating when the determination section determines the malfunction of the rectifier circuit.

14. The apparatus according to claim 11, further comprising:

a power detecting section which detects a voltage of the AC power supply and a current input to the DC circuit and detects power input to the apparatus based on detection results of the voltage and current; and a display section which displays a detection result of the power detecting section as an induction heating output of the coil.

* * * * *